United States Patent [19]

Sakata et al.

[11] Patent Number: 4,683,987

[45] Date of Patent: Aug. 4, 1987

[54] HYDRAULIC POWER PIPING UNIT FOR A LIFT TRUCK

[75] Inventors: Masataka Sakata, Handa; Shigeo Takasu, Obu; Yoshihiro Ikimi, Aichi, all of Japan

[73] Assignee: Kabushiki Kaisha Toyoda Jidoshokki Seisakusho, Aichi, Japan

[21] Appl. No.: 793,635

[22] Filed: Oct. 31, 1985

[30] Foreign Application Priority Data

Nov. 12, 1984 [JP] Japan ..... 59-171891[U]
Nov. 13, 1984 [JP] Japan ..... 59-171058[U]
Nov. 13, 1984 [JP] Japan ..... 59-171059[U]

[51] Int. Cl.[4] ..... B66B 9/20

[52] U.S. Cl. ..... 187/9 E; 414/918; 248/75

[58] Field of Search ..... 187/9 R, 9 E; 137/355.16, 355.17, 355.19, 355.20, 355.23; 414/918, 607; 248/75, 79

[56] References Cited

U.S. PATENT DOCUMENTS

| | | | |
|---|---|---|---|
| 2,622,751 | 12/1952 | Shaffer | 414/918 X |
| 2,791,293 | 5/1957 | Schenkelberger | 414/918 X |
| 2,932,419 | 4/1960 | Harris | 414/918 X |
| 2,979,162 | 4/1961 | Quayle | 414/918 X |
| 3,080,943 | 3/1963 | Goodall | 414/918 X |
| 3,166,208 | 1/1965 | Quayle | 414/918 X |
| 3,462,028 | 8/1969 | Pi | 414/918 X |
| 3,534,766 | 10/1970 | Barto | 137/355.17 X |
| 3,552,425 | 1/1971 | Olson | 137/355.17 |
| 3,612,318 | 10/1971 | Ramsey | 414/918 X |
| 3,894,616 | 7/1975 | Kawanishi et al. | 414/918 X |
| 3,908,859 | 7/1976 | Ehrhardt | 137/355.17 X |
| 4,244,449 | 1/1981 | Renk et al. | 187/9 E |
| 4,487,218 | 12/1984 | Sifri | 137/355.23 X |
| 4,592,449 | 6/1986 | Sakata et al. | 187/9 E |

*Primary Examiner*—Robert J. Spar
*Assistant Examiner*—Jay I. Alexander
*Attorney, Agent, or Firm*—Burgess, Ryan & Wayne

[57] ABSTRACT

A lift truck having a hydraulic power piping unit for interconnecting between a control valve unit and a hydraulic actuator, mounted and encased in a full free lift upright assembly arranged in front of the truck body. The piping unit has a first pulley unit held by a middle tie beam of the vertically liftable inner masts, for guiding one assembly of flexible hydraulic hoses hanging down in a loose U-shape and connected to the control valve unit. The piping unit also has a second pulley unit held coaxially with a chain wheel on a top of a piston rod of a free lift cylinder mounted on the middle tie beam of the inner masts, for supporting the other assembly of flexible hydraulic hoses connected to the hydraulic actuator. The one and the other assemblies of flexible hydraulic hoses are fluidly connected to one another by a hydraulic joint unit held by the middle tie beam.

14 Claims, 10 Drawing Figures

HYDRAULIC POWER PIPING UNIT FOR A LIFT TRUCK

BACKGROUND OF THE INVENTION

1. Field of the Invention

The present invention relates to a hydraulic-power piping unit accommodated in a load-handling lift truck having a truck body and a full free lift upright assembly so as to provide a hydraulic connection between a control valve unit mounted on the truck body and a hydraulic actuator for an attachment mounted on a lift bracket member of the full free lift upright assembly.

2. Description of the Related Art

In a load handling lift truck, specifically, a lift truck having a full free lift upright assembly, it is known to use a hydraulic-power piping unit for providing a hydraulic connection between a control valve unit mounted in a truck body and a hydraulic actuator for a load handling attachment mounted on a free lift bracket which is constructed to be vertically moved by a free lift cylinder disposed in the full free lift upright assembly. The known hydraulic power piping unit has a hose reel on which hydraulic flexible hoses for supply and return of hydraulic power are supported in such a manner that they are able to move together with the free lift bracket. The hose reel is attached to an outer part of the full free lift upright assembly. For example, U.S. Pat. No. 3,552,425 to Harlan D. Olson discloses a hose reel of a hydraulic power line takeup unit located outward from a mast assembly arranged at the front of a lift truck. The outward location of the hydraulic power piping unit, however, contains certain disadvantages in that, when the free lift upright assembly is in an at-rest or non-lift position, the hose reel is close to an overhead guard of the lift truck body resulting in an extremely restricted backward tilt motion of the free lift upright assembly. The outward location of the hydraulic power piping unit also has other disadvantages in that the hose reel, a rotary joint device, and the pipes and hoses of the hydraulic power piping unit are apt to be damaged due to the probability of their coming into contact with objects in the vicinity of the lift truck, and that this position of the unit entails a considerable loss of hydraulic head.

SUMMARY OF THE INVENTION

An object of the present invention is to eliminate the disadvantages engendered by the location of a known hydraulic power piping unit on a lift truck having a full free lift upright assembly.

Another object of the present invention is to provide a novel construction of a hydraulic power piping unit arranged in such a manner that the unit is located inward of and enclosed by the existing full free lift upright assembly.

A still another object of the present invention is to provide a compact hydraulic power piping unit arranged in a narrow lateral spacing of the existing full free lift upright assembly.

In accordance with the present invention, there is provided a hydraulic power piping unit accommodated in a lift truck having a truck body and a full free lift upright assembly which includes a pair of laterally spaced outer stationary masts connected together by at least a cross beam, a pair of laterally spaced inner masts connected together by upper and middle tie beams and movable vertically relative to the outer stationary masts, and a free lift cylinder attached to the middle tie beam of the inner masts for providing a free lift movement for a bracket member relative to the inner masts. The hydraulic power piping unit is assembled in the full free lift upright assembly to enable connection to be made between a hydraulic control valve unit mounted in the truck body and a hydraulic actuator for an attachment to be mounted on the bracket member. The hydraulic power piping unit is characterized by comprising support means attached to the cross beam of the outer stationary masts, for holding a first assembly of hydraulic hoses extending toward the hydraulic control valve unit, a first pulley unit rotatably and vertically movably held by the middle tie beam of the movable inner masts, for guiding a second assembly of hydraulic hoses hanging down in a loose U-shape and having first upper ends thereof connected to the first assembly of hydraulic hoses and second upper ends thereof, a second pulley unit rotatably mounted on a vertical piston rod of the free lift cylinder, for supporting a third assembly of hydraulic hoses extended in a loose inverted U-shape and having first lower ends thereof connectable to the hydraulic actuator and second lower ends thereof, and joint means attached to the middle tie beam of the movable inner masts, for fluid interconnection between the second upper ends of the second assembly of hydraulic hoses and the second lower ends of the third assembly of hydraulic hoses.

Other objects, advantages and features of the invention will be made apparent from the ensuing description taken in conjunction with the attached drawings.

DESCRIPTION OF THE PREFERRED EMBODIMENTS

Figure 1:
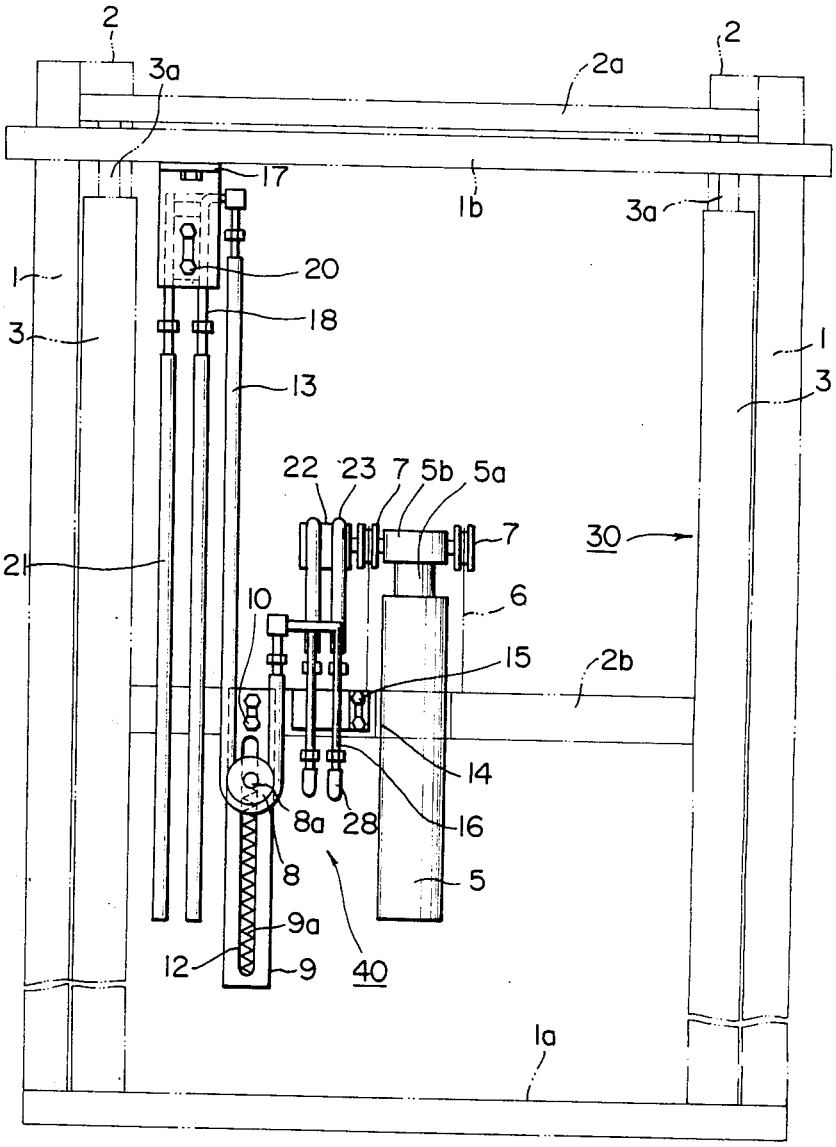
FIG. 1 is a front elevational view of a hydraulic power piping unit, according to an embodiment of the present invention, encased in a full free lift upright assembly of a lift truck.
Figure 2:
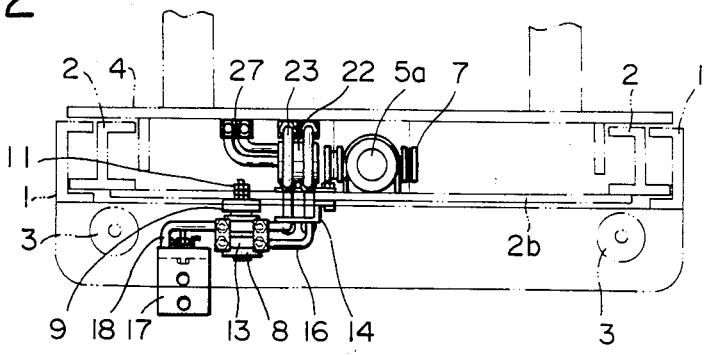
FIG. 2 is a plan view of the hydraulic power piping unit of FIG. 1.
Figure 3:
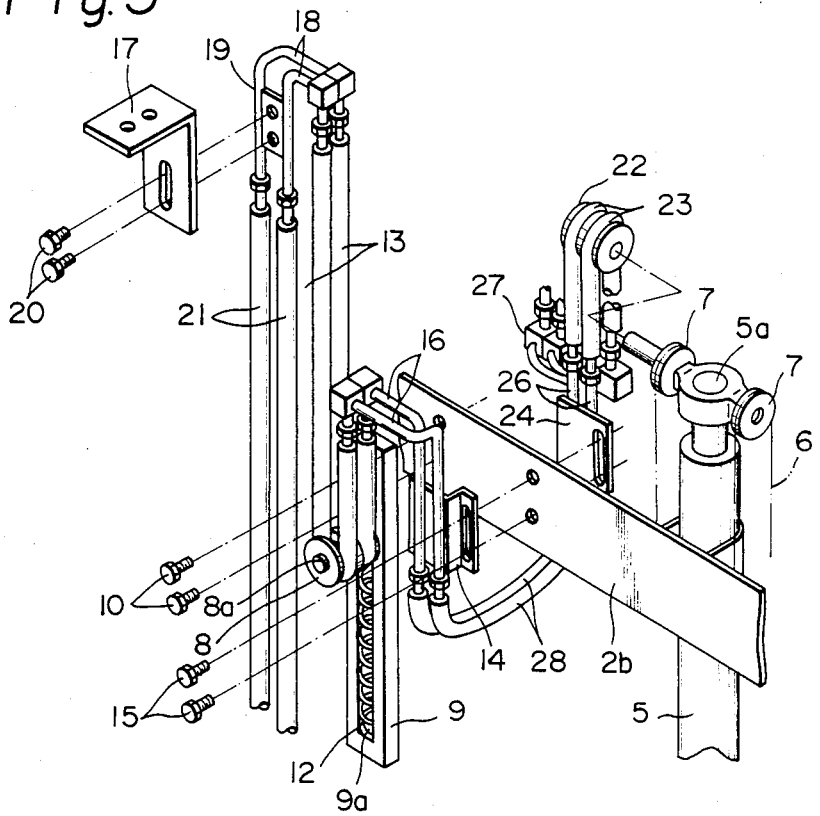
FIG. 3 is an exploded perspective view of the hydraulic power piping unit of FIG. 1.

Referring to FIGS. 1 through 3, a full free lift upright assembly 30 includes a pair of laterally spaced stationary outer masts 1 and a pair of laterally spaced inner masts 2 arranged so as to be moved relative to the outer masts 1 by a pair of lift cylinders 3 positioned on the back of the inner masts 2. The pair of lift cylinders 3 are supported by a lower cross beam 1*a*, and piston rods 3*a* of the two lift cylinders 3 are connected respectively to an upper tie beam 2*a* of the pair of inner masts 2. The full free lift upright assembly 30 also includes a lift bracket member 4 having freedom of movement which is moved vertically relative to the inner masts 2 by a free lift cylinder 5 positioned centrally between the laterally spaced inner masts 2, and a pair of chains 6. The chains 6 are supported by a pair of chain pulleys 7 pivotally mounted on both sides of an upper end of a piston rod 5*a* of the free lift cylinder 5. One end of the respective lift chains 6 is fixedly attached to a middle tie beam 2*b* of the inner masts 2, and the other end of respective lift chains 6 is fixedly attached to the lift bracket member 4. The free lift cylinder 5 is supported by the middle tie beam 2*b*. Thus, when the free lift cylinder 5 is operated so as to extend the piston rod 5*a*, the lift bracket member 4 on which a load handling attachment (not illustrated in FIGS. 1 through 3) is mounted is moved vertically against the inner masts 2.

A hydraulic power piping unit 40 is assembled in the above-described full free lift upright assembly 30 so that the supply of hydraulic power to a hydraulic actuator (not illustrated) for the attachment as well as the return of hydraulic power from the hydraulic actuator are conducted by the hydraulic power piping unit 40. The hydraulic power piping unit 40 includes a first hose pulley 8 having a horizontal shaft 8*a*. The hose pulley 8 is held by a vertically longitudinal support member 9 which is attached to the back side of the above-described middle tie beam 2*b* by means of screw bolts 10 between the free lift cylinder 5 and one of the inner masts 2. The attachment of the support member 9 to the middle tie beam 2*b* can be vertically adjusted when tightening the screw bolts 10. The horizontal shaft 8*a* about which the pulley 8 rotates is received in a vertically longitudinal opening 9*a* of the support member 9 and is clamped by nuts 11 threadedly engaged with a threaded end of the shaft 8*a* on the front side of the middle beam 2*b*. The hose pulley 8 is, however, held movable in the vertical direction within the opening 9*a*, via the horizontal shaft 8*a*, and is downwardly biased by a spring 12 housed in the vertically longitudinal opening 9*a* of the support member 9. In the illustrated embodiment, the spring 12 is a tension spring which pulls down the hose pulley 8. A compression spring may alternately be used for pressing down the hose pulley 8. The pulley 8 is arranged so as to guide the flexible hoses 13 hanging down in a loose U-shape and having one upper end connected to rigid joint pipes 16 which are fixedly attached to the middle tie beam 2*b* by means of a pipe bracket 14 and screw bolts 15. The other ends of the flexible hoses 13 are connected to rigid joint pipes 18 which are fixedly attached to a lower face of an upper cross beam 1*b* by means of a support bracket 17 in the form of a right-angled metallic bracket. The position of the rigid joint pipes 18 is vertically adjustable relative to the support bracket 17, since a bracket 19 attached to the joint pipes 18 can be vertically adjustably mounted on the support bracket 17 by the use of a vertically elongated opening of the support bracket 17 and screw bolts 20. The rigid joint pipes 18 per se are connected to the control valve unit (not illustrated in FIGS. 1 through 3) mounted on a lift truck body described later.

The hydraulic power piping unit 40 also includes a second hose pulley 22 mounted coaxially with the chain pulleys 7 of the free lift cylinder 5. The second hose pulley 22 holds thereon flexible hydraulic hoses 23 in the form of a loose inverted U-shape. The flexible hydraulic hoses 23 have one end connected to rigid joint pipes 26 which are vertically adjustably attached to the front side of the tie beam 2*b* by means of a pipe bracket 24 having a vertically elongated opening and by means of screw bolts 15 which are used commonly for the afore-described pipe bracket 14. The other ends of the flexible hydraulic hoses 23 are connected to a pipe joint 27 of the hydraulic actuator, fixed to the lift bracket 4. Flexible hydraulic hoses 28 are provided for interconnection between the rigid joint pipes 16 and 26.

The hydraulic power piping unit 40, described above is compactly encased in the full free lift upright assembly 30, and is therefore prevented from being damaged during the operation of the lift truck.

When the lift cylinder 5 is operated, only the lift bracket member 4 is moved vertically relative to the middle tie beam 2*b* of the inner masts 2. Thus, the flexible hydraulic hoses 13 guided by the hose pulley 8 are kept stationary during the free lift movement of the lift bracket member 4. On the other hand, since the hose pulley 22 mounted on the top of the vertical piston rod 5*a* of the lift cylinder 5 moves vertically at a speed half of that of the lift bracket member 4, the flexible hydraulic hoses 23 held by the hose pulley 22 move around the hose pulley 22 under a predetermined tension, in response to the vertical free lift movement of the lift bracket member 4.

When the pair of lift cylinders 3 are operated, the inner masts 2, the free lift cylinder 5, and the lift bracket member 4 are moved vertically all together relative to the stationary outer masts 1. Thus, the flexible hydraulic hoses 23 are kept stationary with respect to the inner masts 2, while the flexible hydraulic hoses 13 guided by the hose pulley 8 are moved on one side thereof having the upper ends connected to the rigid joint pipes 16, together with the middle tie beam 2*b* and the hose pulley 8. During the movement of the flexible hydraulic hoses 13, the tension of the flexible hydraulic hoses 13 is kept constant by the vertical movability of the hose pulley 8 within the vertically longitudinal opening 9*a* of the support member 9. That is, when the inner masts 1 move up, the biasing spring 12 in the opening 9*a* of the support member 9 pulls the hose pulley 8 down, preventing any relaxation in the flexible hydraulic hoses 13. When the inner masts 1 move down, the biasing spring 12 stretches and prevents the application of excess tension to the flexible hydraulic hoses 13. As a result, the movement of the flexible hydraulic hoses 13 always follows constantly to that of the inner masts 1. Accordingly, a long and undamaged operating life is ensured for the hydraulic power piping unit 40.

In the embodiment of FIGS. 1 through 3, the piping system of two flexible hydraulic hoses is illustrated. However, any other piping system of four or six flexible hydraulic hoses may be realized by the present invention. In such embodiments, the flexible hydraulic hoses may be symmetrically arranged on both sides of the free lift cylinder 5.

Figure 4:
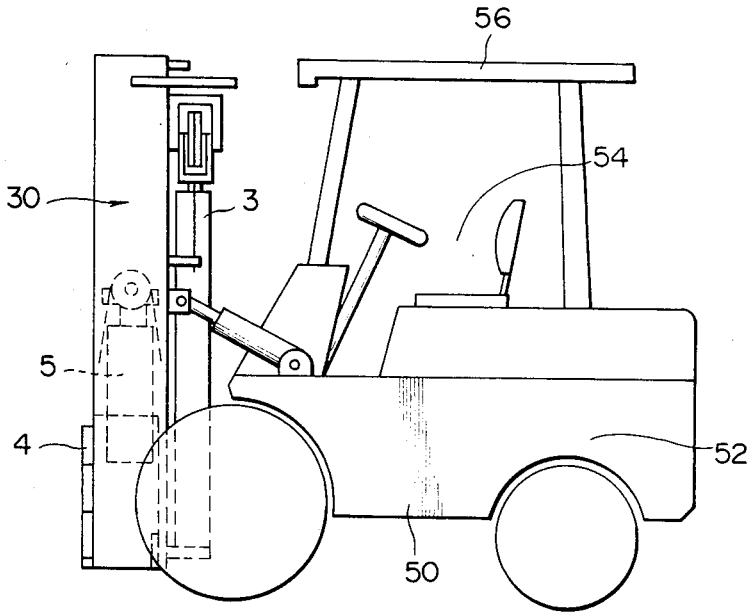
FIG. 4 is a side elevational view of a typical load handling truck in which the hydraulic power piping unit of FIG. 1 can be fitted.

FIG. 4 illustrates a typical load handling lift truck in which the hydraulic power piping unit 40 as described hereinbefore can be accommodated. The lift truck 50 has a wheeled truck body 52 in which a driver's seat 54 covered by an overhead guard 56 is mounted. In front of the truck body 52, the full free lift upright assembly 30 tiltable in both forward and back direction is assembled, having the lift cylinders 3, the free lift cylinder 5, and the lift bracket member 4. The hydraulic power piping unit 40 (not illustrated) is assembled and encased in the upright assembly 30, and thus the tilting backward of the upright assembly 30 toward the truck body 52 is not limited in any way.

Figure 5:
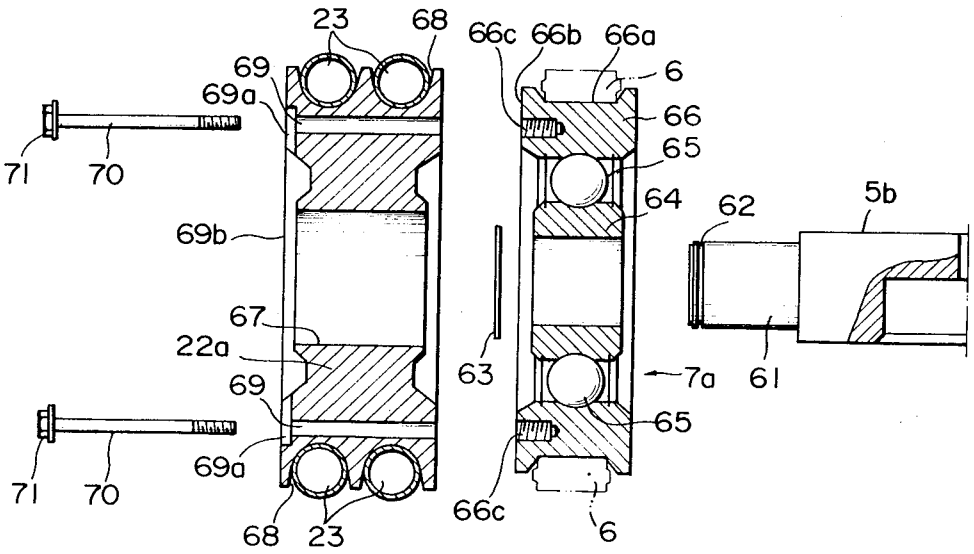
FIG. 5 is an exploded cross-sectional view of a hose pulley and a chain pulley attached to a top of a piston rod of a free lift cylinder, according to an embodiment of the present invention.
Figure 6:
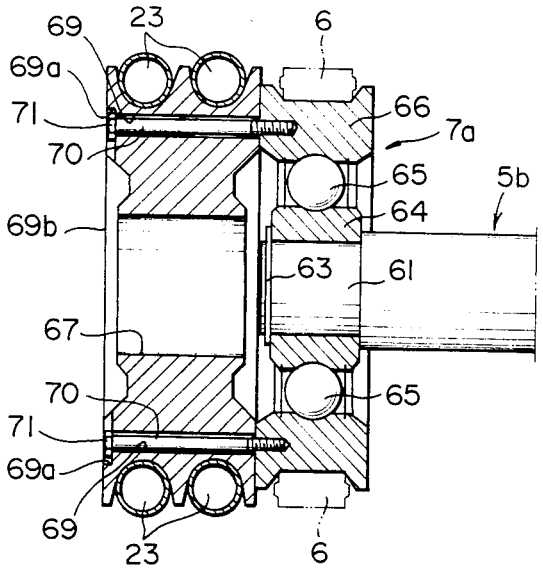
FIG. 6 is a cross-sectional view of the hose pulley and chain pulley of FIG. 5 when assembled.

FIGS. 5 and 6 illustrate an embodiment of a coaxial mounting arrangement of the hose pulley and one of the chain pulleys on a pulley support provided on the top of the piston rod 5*a* of the free lift cylinder 5. In FIGS. 5 and 6, the pulley support designated by 5*b* is formed, at an end section, with a cylindrical mount 61 having an annular groove 62 at an outermost end of the cylindrical mount 61. The annular groove 62 is provided for receiving therein an elastic retaining ring or snap ring 63. On the cylindrical mount 61 is rotatably mounted the chain wheel or pulley 7*a* having an inner race 64 fitted on the cylindrical mount 61, bearing balls 65 and an outer race 66 formed with an outer receiver 66*a* in which the chain 6 (FIG. 1) is received. That is, the chain pulley 7*a* is formed in the shape of a typical radial bearing. The chain pulley 7*a* is prevented from coming off by the elastic retaining ring 63 and thus is stably retained on the cylindrical mount 61. At the outer end face 66*b* of the outer race 66, a plurality of axial threaded holes 66*c* are provided disposed in a circle concentric with the axis of the central bore of the inner race 64.

The hose pulley 22*a* is provided with a central bore 67 having an inner diameter larger than the diameter of the elastic retaining ring 63, and outer annular grooves 68 to receive therein flexible hydraulic hoses 23. The hose pulley 22*a* is also provided with a plurality of axial through-holes 69 disposed in a circle having the same diameter as the circle in which the above-mentioned axial threaded holes 66 are disposed. The number of the through-holes 69 corresponds to that of the threaded holes 66*c*. Therefore, as illustrated in FIG. 6, the hose pulley 22*a* can be coaxially and directly attached to the outer end face 66*b* of the chain pulley 7*a* by the use of screw bolts 70. The head 71 of each screw bolt 70 is seated in a corresponding counterbore 69*a* formed in an outer end face 69*b* of the hose pulley 22*a* around each through-bore 69. Accordingly, when the screw bolts 70 are tightly screwed into the threaded holes 66*c* of the chain pulley 7*a*, there are no projections from the outer end face 69*b* of the hose pulley 22*a*. The hose pulley 22*a* is always subjected to a relatively light load compared with the load applied to the chain pulley 7, and thus the screw bolts 70 may be small in diameter.

The above-mentioned coaxial mounting of the hose pulley and the chain pulley contributes to making the assembly of the hydraulic power piping unit of the present invention compact. As a result, the hydraulic power piping unit is readily accommodated in a narrow space in the full free lift upright assembly 30.

Figure 7:
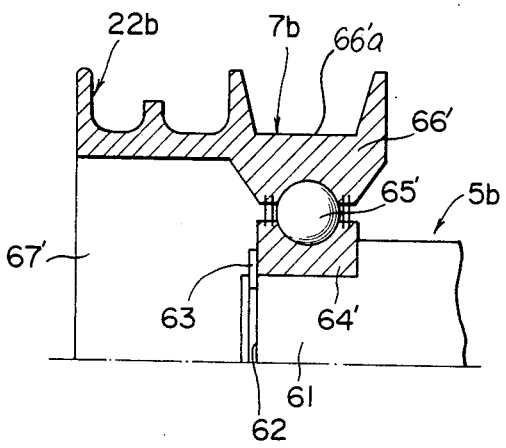
FIG. 7 is an enlarged partial cross-sectional view of a hose pulley and a chain pulley, according to another embodiment of the present invention.

FIG. 7 illustrates another embodiment of the coaxial mounting arrangement of the hose pulley and one of the chain pulleys. In the embodiment of FIG. 7, the chain pulley 7*b* includes an inner race 64' mounted on the mount 61 of the pulley support 5*b*, bearing balls 65', and an outer race 66' having outer annular grooves 66'*a* to receive therein the chains 6. The hose pulley 22*b* is formed as one part with the outer race 66' of the chain pulley 7*b*. A large central bore 67' is used for fitting the elastic retaining ring 63 in the groove 62 of the mount 61.

Figure 8:
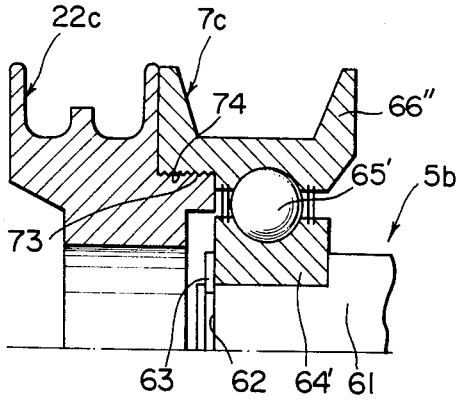
FIG. 8 is a partial enlarged cross-sectional view of a hose pulley and a chain pulley, according to a further embodiment of the present invention.

FIG. 8 illustrates still another embodiment of the coaxial mounting arrangement of the hose pulley and one of the chain pulleys. The embodiment of FIG. 8 is different from that of FIG. 7 in that the hose pulley 22*c* is threadedly engaged with an outer race 66'' of the chain pulley 7*c*. Thus, the hose pulley 22*c* is formed, at an inner end, with a male threaded projection 73 which is engaged with a female threaded bore 74 of the outer race 66'' of the chain pulley 7*c*.

It should be appreciated that, in the embodiments of FIGS. 7 and 8, since screw bolts are not used, the attachment of the hose pulley 22*b* or 22*c* to the pulley support 5*b* is simplified compared with the embodiment of FIGS. 5 and 6.

If the hydraulic power piping unit of the present invention employs the piping system having four or more hydraulic hoses, the mounting arrangement of the hose pulley and one of the chain pulleys, as shown in FIGS. 5 through 8 may be arranged on both sides of the free lift cylinder 5 (FIGS. 1 through 3).

Figure 9:
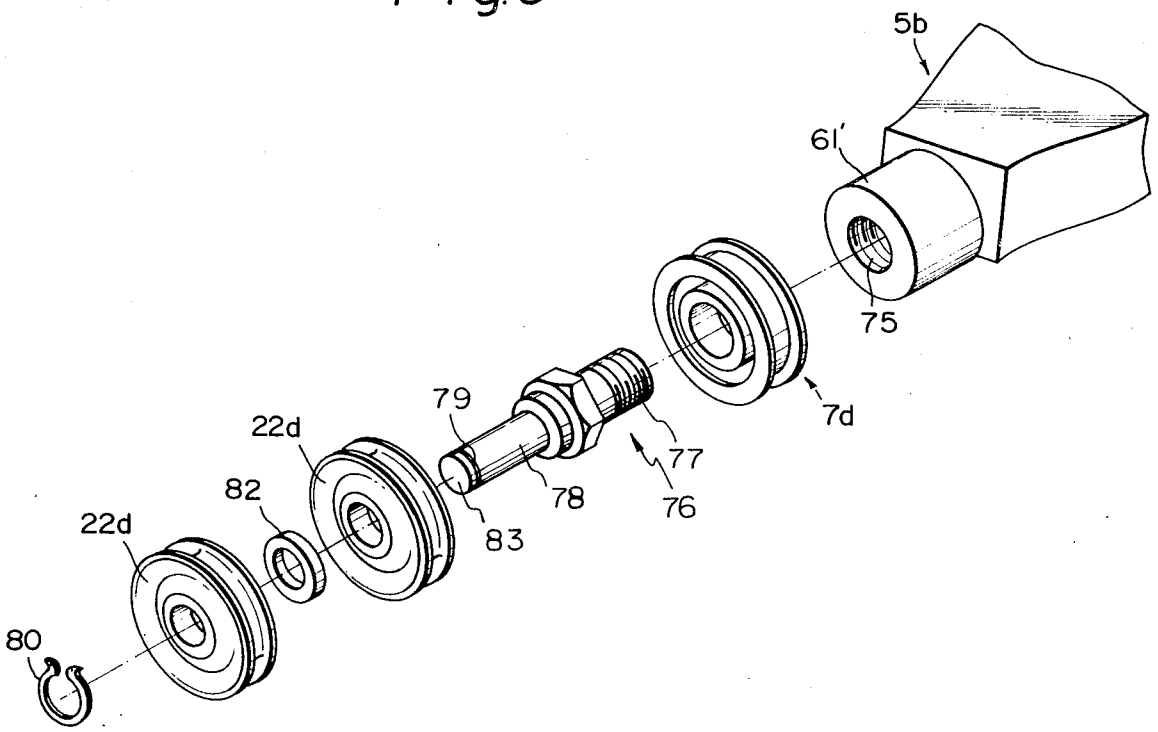
FIG. 9 is an exploded perspective view of a hose pulley and a chain pulley attached to a top of a piston rod of a free lift cylinder, according to a still further embodiment of the present invention.
Figure 10:
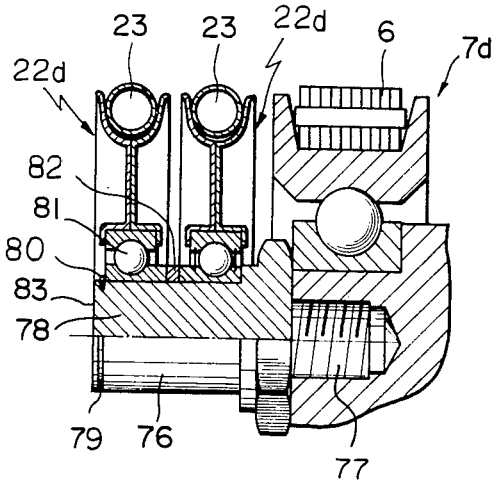
FIG. 10 is a cross-sectional view of a part of the hose and chain pulleys of FIG. 9 when assembled.

FIGS. 9 and 10 illustrate a further embodiment of the coaxial mounting arrangement of the hose pulley and one of the chain pulleys.

In FIGS. 9 and 10, the chain pulley 7*d* has substantially the same construction as the chain pulley 7*a* of FIGS. 5 and 6 and is mounted on a mount 61' of the pulley support 5*b*. The mount 61' of the pulley support 5*b* is formed, at an end, with an axial threaded bore 75 into which a pulley pin 76 is threadedly engaged by the use of threaded end 77 of the pulley pin 76. The pulley pin 76 is provided with a cylindrical pulley mount 78 having, at its end, an annular groove 79 to receive therein a snap ring 80. Hose pulleys 22*d* are mounted on the cylindrical pulley mount 78 by means of rotating bearings 81. The hose pulleys 22*d* are spaced apart form one another by the intervention of a spacing element 82. The snap ring 80 fitted in the annular groove 79 prevents the hose pulleys 22*d* from coming off the cylindrical mount 78. An end face 83 of the pulley mount 78 of the pulley pin 76 is located inside the outermost end face of the outward hose pulley 22*d*. Thus, there are no projections from the outermost end face of the outward hose pulley 22*d*. Therefore, the coaxial mounting arrangement of the hose pulleys 22*d* and the chain pulley 7*d* can have a sufficiently small axial width. As a result, the coaxial mounting arrangement of FIGS. 9 and 10 permits the assembly of the hydraulic power piping unit of the present invention to be accommodated in a narrow space in the full free lift upright assembly.

From the foregoing description, it will be understood that, in accordance with the present invention, an improved compact hydraulic power piping unit free from the likelihood of damage and capable of enhancing the function of the full free lift upright assembly is provided. However, it should be understood that various modifications of this invention may occur to those persons skilled in the art without departing from the spirit and scope of the present invention.

We claim:

1. In a lift truck having a truck body and a full free lift upright assembly, the assembly including a pair of laterally spaced outer stationary masts connected together by at least a cross beam, a pair of laterally spaced inner masts connected together by upper and middle tie beams and movable vertically relative to the outer stationary masts, and a free lift cylinder attached to the middle tie beam of the inner masts for providing a free lift movement for a bracket member relative to the inner masts;

said middle tie beam being arranged approximately midway of said inner masts in a vertical direction;

a hydraulic power piping unit for a connection between a hydraulic control valve unit mounted in the truck body and a hydraulic actuator for an attachment to be mounted on the bracket member, comprising:

support means attached to said cross beam of said outer stationary masts, for holding a first assembly of hydraulic hoses extending toward said hydraulic control valve unit;

a first pulley means rotatably held by said middle tie beam of said moveable inner masts and vertically movable with respect to said middle tie beam of said movable outer masts, for guiding a second assembly of flexible hydraulic hoses hanging down in a loose U-shape and having first upper ends thereof connected to said first assembly of hydraulic hoses and second upper ends thereof, said first pulley means including an elongated support member extending from said middle tie beam which connects said inner masts, said support member having a vertical opening, a pulley shaft slidably supported in said vertical opening, and a pulley rotatably mounted on said pulley shaft;

spring biasing means for biasing said pulley downwardly in a vertical direction with respect to said middle tie beam of said movable inner masts to maintain said second assembly of hydraulic hoses in a taut condition during operation of said lift truck;

a second pulley means rotatably mounted on a vertical piston rod of said free lift cylinder, for supporting a third assembly of flexible hydraulic hoses extended in a loose inverted U-shape and having first lower ends thereof connectable to said hydraulic actuator and second lower ends thereof; and joint means attached to said middle tie beam of said movable inner masts, for fluidly connecting said second upper ends of said second assembly of hydraulic hoses and said second lower ends of said third assembly of hydraulic hoses.

2. The hydraulic power piping unit according to claim 1, wherein said cross beam of said outer stationary masts is an upper cross beam laterally connecting said pair of outer stationary masts, and wherein said support means comprise a rigid bracket member fixed to said upper cross beam.

3. The hydraulic power piping unit according to claim 2, wherein said rigid bracket member is an L-shape metallic plate.,

4. The hydraulic power piping unit according to claim 2, wherein said first assembly of hydraulic hoses comprise flexible hoses connected by rigid joint pipes connected to said second assembly of hydraulic hoses comprising flexible hoses, said joint pipes being fixed to said rigid bracket member.

5. The hydraulic power piping unit according to claim 1, wherein said third assembly of hydraulic hoses comprise flexible hoses.

6. The hydraulic power piping unit according to claim 1, wherein said joint means comprise a first assembly of rigid joint pipes extended so as to be connected to said second upper ends of said second assembly of hydraulic hoses, a second assembly of rigid joint pipes extended so as to be connected to said second lower ends of said third assembly of hydraulic hoses, and an assembly of flexible hoses connecting said first and second rigid joint pipes to one another.

7. The hydraulic power piping unit according to claim 1, wherein said spring biasing means comprise a tension spring housed in said vertical opening of said support member.

8. The hydraulic power piping unit according to claim 1, wherein said second pulley means comprise a hose pulley pivotally mounted on a top of said vertical piston of said free lift cylinder.

9. The hydraulic power piping unit according to claim 8, wherein said hose pulley is coaxially attached to a chain pulley pivotally mounted on said top of said vertical piston of said free lift cylinder.

10. The hydraulic power piping unit according to claim 9, wherein said hose pulley is attached to said chain pulley by means of screw bolts.

11. The hydraulic power piping unit according to claim 9, wherein said hose pulley is threadedly attached to said chain pulley.

12. The hydraulic power piping unit according to claim 9, wherein said hose pulley is formed integrally with said chain pulley.

13. The hydraulic power piping unit according to claim 8, wherein said hose pulley is mounted on a pin attached to said top of said vertical piston rod of said free lift cylinder and maintaining thereon a chain pulley commonly and coaxially with said hose pulley.

14. The hydraulic power piping unit according to claim 13, wherein said hose pulley rotatably mounted on said pin is clamped by elastic ring means fitted in an end groove of said pin.

* * * * *